US008004264B2

(12) United States Patent
Lee et al.

(10) Patent No.: US 8,004,264 B2
(45) Date of Patent: Aug. 23, 2011

(54) VOLTAGE CONVERTER

(75) Inventors: Chow-Peng Lee, Sinshih Township, Tainan County (TW); Aung Aung Yinn, Sinshih Township, Tainan County (TW); Tyng-Yang Chen, Sinshih Township, Tainan County (TW)

(73) Assignee: Himax Analogic, Inc., Tainan County (TW)

( * ) Notice: Subject to any disclaimer, the term of this patent is extended or adjusted under 35 U.S.C. 154(b) by 451 days.

(21) Appl. No.: 12/236,100

(22) Filed: Sep. 23, 2008

(65) Prior Publication Data

US 2010/0072973 A1 Mar. 25, 2010

(51) Int. Cl.
*G05F 3/08* (2006.01)

(52) U.S. Cl. ..... 323/312; 323/315

(58) Field of Classification Search ..... 323/312, 323/313, 314, 315, 316
See application file for complete search history.

(56) References Cited

U.S. PATENT DOCUMENTS

| | | | | |
|---|---|---|---|---|
| 5,889,431 | A * | 3/1999 | Csanky | 327/543 |
| 7,268,528 | B2 * | 9/2007 | Noda | 323/312 |
| 2009/0001959 | A1 * | 1/2009 | Tang | 323/315 |

* cited by examiner

*Primary Examiner* — Adolf Berhane
(74) *Attorney, Agent, or Firm* — Thomas, Kayden, Horstemeyer & Risley, LLP

(57) ABSTRACT

A voltage converter to convert a high voltage to a low voltage is provided. The voltage converter comprises: a current mirror, a current bias, a plurality of loads and a low voltage output. The current mirror comprises a first PMOS and a second PMOS, wherein the source of the first PMOS and the second PMOS receive a high voltage input which is a supply voltage of the current mirror, and the gate of the first PMOS is connected to the drain of the first PMOS. The current bias is connected between the drain of the first PMOS and a ground potential. The plurality of loads are parallel connected between the drain of the second PMOS and the ground potential. And the low voltage output connected to the drain of the second PMOS.

9 Claims, 2 Drawing Sheets

VOLTAGE CONVERTER

BACKGROUND

1. Field of Invention

The present invention relates to a voltage converter. More particularly, the present invention relates to a voltage converter to convert a high voltage to a low voltage.

2. Description of Related Art

In current integrated circuit design, some circuits have only high voltage power supply input. In order to provide the low voltage modules with less area in the integrated circuit an accurate reference voltage, i.e. a low voltage, a voltage converter is necessary to transfer the high voltage power supply into a lower voltage. However, the additional module to generate the reference voltage will certainly make the area of the integrated circuit larger. Also, the semiconductor devices with different fabrication process tend to affect the accuracy of the transferred voltage.

Accordingly, what is needed is a voltage converter to generate an accurate low voltage from a high voltage with a small area to overcome the above issues. The present invention addresses such a need.

SUMMARY

A voltage converter to convert a high voltage to a low voltage is provided. The voltage converter comprises: a current mirror, a current bias, a plurality of loads and a low voltage output. The current mirror comprises a first PMOS and a second PMOS, wherein the source of the first PMOS and the second PMOS receive a high voltage input which is a supply voltage of the current mirror, and the gate of the first PMOS is connected to the drain of the first PMOS. The current bias is connected between the drain of the first PMOS and a ground potential. The plurality of loads are connected in parallel between the drain of the second PMOS and the ground potential. And the low voltage output connected to the drain of the second PMOS.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
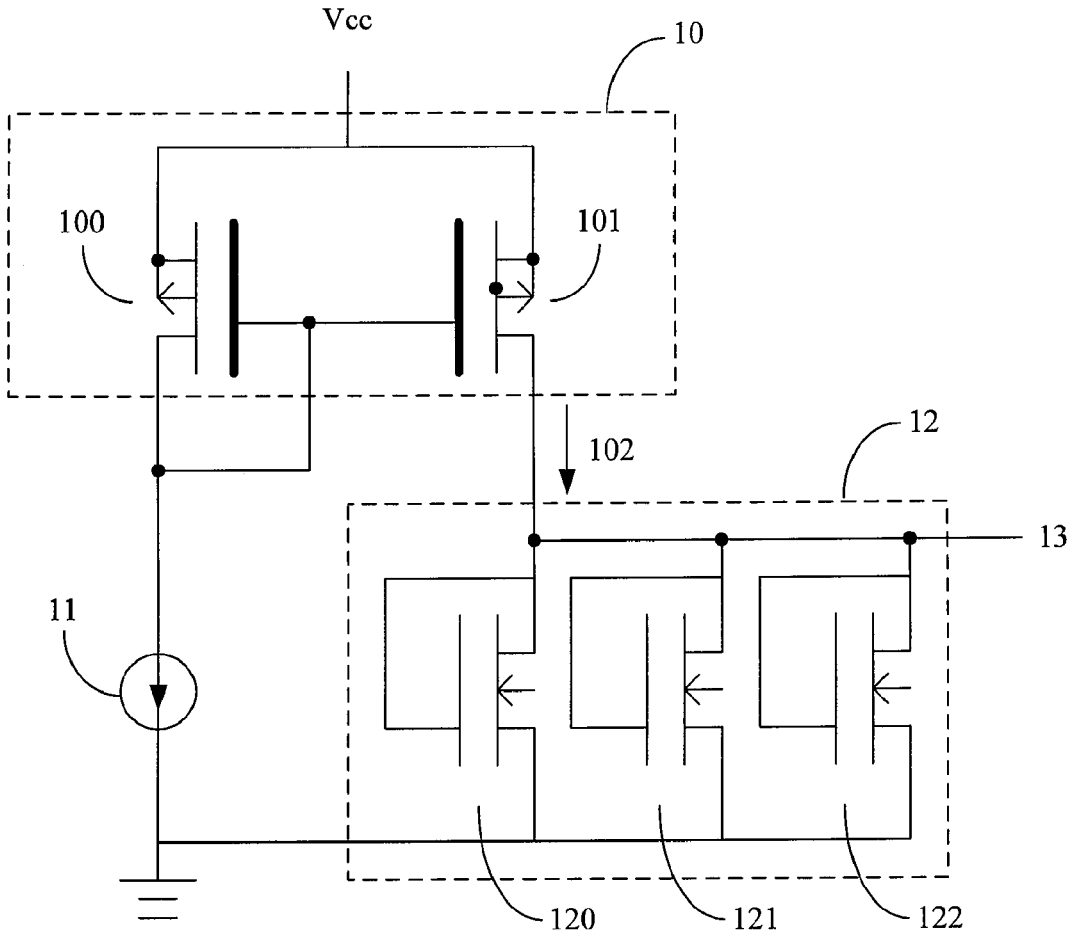
FIG. 1 is a voltage converter of the first embodiment of the present invention.

Reference will now be made in detail to the present embodiments of the invention, examples of which are illustrated in the accompanying drawings. Wherever possible, the same reference numbers are used in the drawings and the description to refer to the same or like parts.

Please refer to FIG. 1, a voltage converter 1 of the first embodiment of the present invention. The voltage converter 1 comprises a current mirror 10, a current bias 11, a plurality of loads 12 and a low voltage output 13. The current mirror 10 comprises a first PMOS device 100 and a second PMOS device 101, wherein the source of the first PMOS device 100 and the second PMOS device 101 receive a high voltage input Vcc that is a supply voltage of the current mirror 10, and the gate of the first PMOS device 100 is connected to the drain of the first device PMOS 100. In order to endure the high voltage input Vcc, the first PMOS device and the second PMOS device are both high voltage PMOS (HVPMOS) that can endure high voltage.

The current bias 11 is connected between the drain of the first PMOS 100 and a ground potential. The loads 12 in the present embodiment comprise three enhancement NMOS devices 120, 121 and 122. The three enhancement NMOS devices 120, 121 and 122 are parallel connected between the drain of the second PMOS 101 and the ground potential. And the low voltage output 13 is connected to the drain of the second PMOS 101. Through the current mirror 10, a current 102 is generated according to the current bias 11 to provide the load 12 a stable current. Further, the three enhancement NMOS devices 120, 121 and 122 are low voltage NMOS (LVNMOS). The high voltage from Vcc is split equally by the three enhancement NMOS 120, 121 and 122. Thus, a lower voltage at the low voltage output 13 is generated.

In other embodiment, the number of the NMOS devices of the loads 12 can be different to generate a different value of low voltage output 13. If more NMOS devices are connected in parallel, the high voltage is split by more NMOS devices. Therefore a lower voltage output is generated. If less NMOS devices are connected in parallel, the high voltage is split by less NMOS devices. Therefore the voltage output generated at the low voltage output 13 is higher. Yet in another embodiment, the loads 12 can comprise a plurality of resistors to generate the low voltage output. But it's noticed that the area of the resistor is much larger than the NMOS device, and the fabrication process of the NMOS is much easier to control as compared to the resistor.

Figure 2:
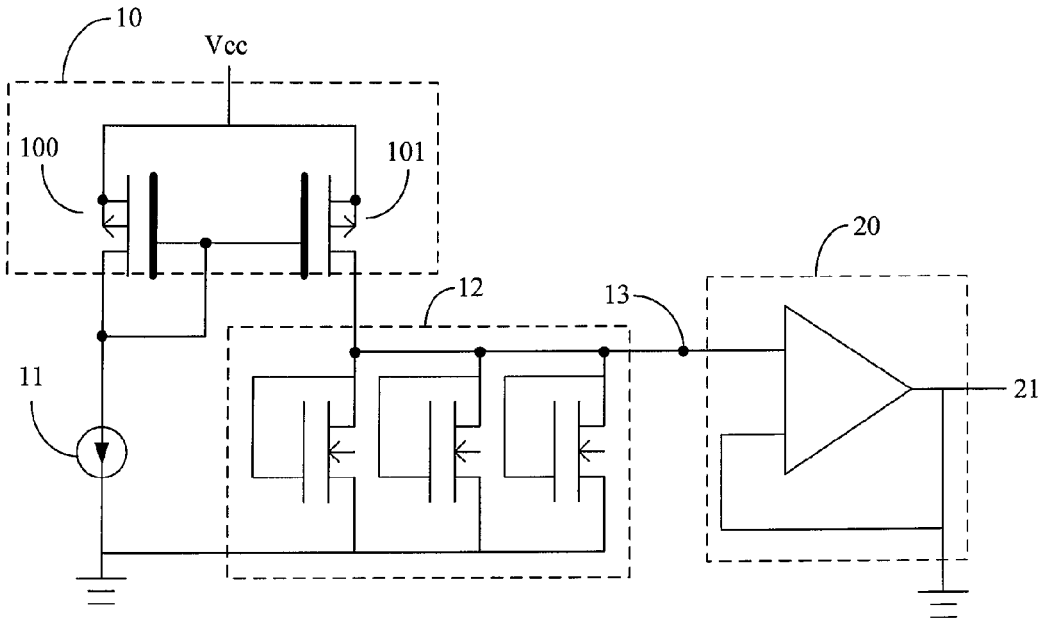
FIG. 2 is a voltage converter with a buffer of another embodiment of the present invention.
Figure 3:
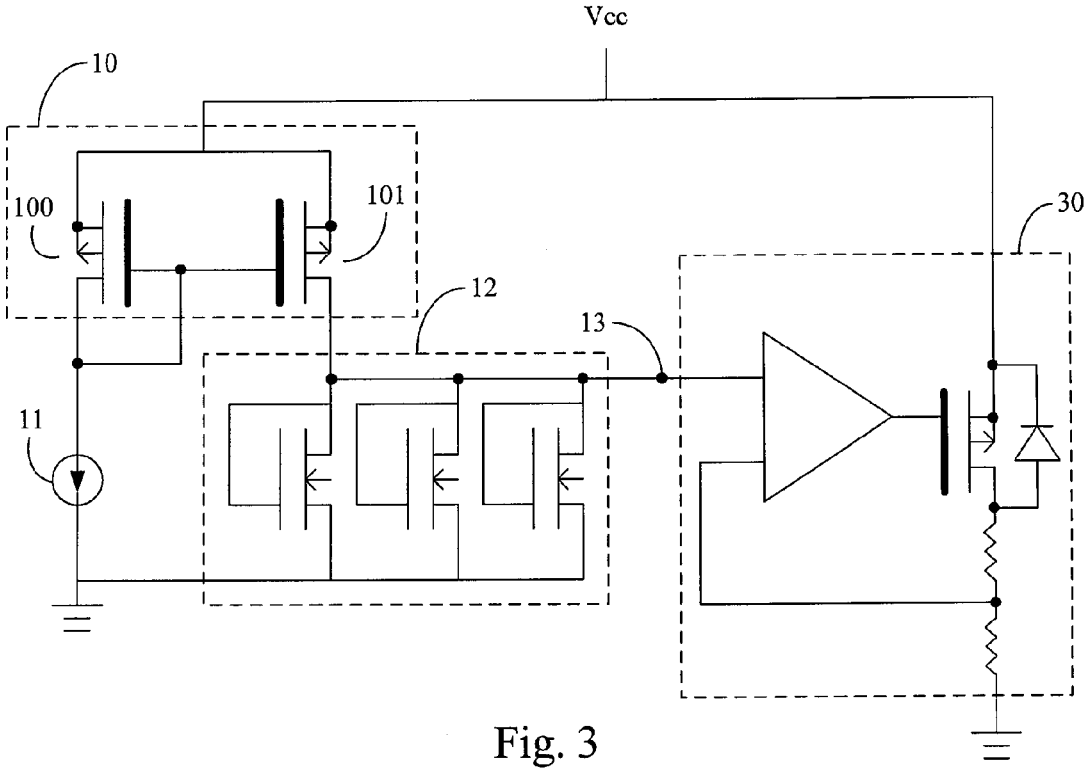
FIG. 3 is a voltage converter with a low drop-out regulator of yet another embodiment of the present invention.

In order to generate a more stable reference voltage to the low voltage module in an integrated circuit, a buffer 20 can be connected to the low voltage output 13 to generate the reference voltage 21 as depicted in FIG. 2. Furthermore, the low voltage output 13 can further connects to a reference voltage input of a low drop-out regulator 30 as depicted in FIG. 3, wherein the supply voltage of the low drop-out regulator receives the high voltage input Vcc of the current mirror 10 to generate a high accuracy low voltage power supply 32.

The voltage converter of the present invention can generate an accurate low voltage from a high voltage due to the stable current bias and the voltage split of the loads, and the low voltage NMOS of the loads have a small area size to accomplish the voltage transfer.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A voltage converter to convert a high voltage to a low voltage comprising:

a current mirror comprising a first PMOS device and a second PMOS device, wherein the source of the first PMOS device and the second PMOS device receive a high voltage input which is a supply voltage of the current mirror, the gate of the first PMOS is connected to the drain of the first PMOS, wherein the first PMOS device and the second PMOS device are high voltage PMOS devices;

a current bias connected between the drain of the first PMOS device and a ground potential;

a plurality of loads parallel connected between the drain of the second PMOS device and the ground potential, wherein the loads are diode-connected low voltage transistors; and a low voltage output connected to the drain of the second PMOS device.

2. The voltage converter of claim 1, wherein the plurality of diode-connected low voltage transistors are a plurality of enhancement NMOS devices.

3. The voltage converter of claim 1, wherein the low voltage output further connects to a reference voltage input of a low drop-out regulator, wherein the supply voltage of the low drop-out regulator receives the high voltage input of current mirror.

4. The voltage converter of claim 1, wherein the low voltage output further connects to a buffer to generates a reference voltage.

5. The voltage converter of claim 1, wherein the voltage level of the low voltage output depends on the number of the loads.

6. A voltage regulator comprising:

a voltage converter comprising:

a current mirror comprising a first PMOS device and a second PMOS device, wherein the source of the first PMOS device and the second PMOS device receive a high voltage input which is a supply voltage of the current mirror, the gate of the first PMOS device is connected to the drain of the first PMOS device, wherein the first PMOS device and the second PMOS device are high voltage PMOS devices;

a current bias connected between the drain of the first PMOS device and a ground potential;

a plurality of loads parallel connected between the drain of the second PMOS device and the ground potential, wherein the loads are diode-connected low voltage transistors; and a low voltage output connected to the drain of the second PMOS device; and a regulator having an input connected to the low voltage output, and having an output to output a low-voltage power supply voltage.

7. The voltage regulator of claim 6, wherein the plurality of diode-connected low voltage transistors are a plurality of enhancement NMOS devices.

8. The voltage regulator of claim 6, wherein the supply voltage of the low drop-out regulator receives the high voltage input of the current mirror.

9. The voltage regulator of claim 6, wherein the voltage level of the low voltage output depends on the number of the loads.

* * * * *